US010619595B2

(12) United States Patent
Acocella

(10) Patent No.: US 10,619,595 B2
(45) Date of Patent: Apr. 14, 2020

(54) BURNER-HEAT EXCHANGER ASSEMBLY FOR AN EXTERNAL COMBUSTION ENGINE

(71) Applicant: WORGAS BRUCIATORI S.R.L., Formigine, Modena (IT)

(72) Inventor: Antonio Acocella, Modena (IT)

(73) Assignee: WORGAS BRUCIATORI S.R.L., Formigine, Modena (IT)

( * ) Notice: Subject to any disclaimer, the term of this patent is extended or adjusted under 35 U.S.C. 154(b) by 85 days.

(21) Appl. No.: 16/070,702

(22) PCT Filed: Dec. 29, 2016

(86) PCT No.: PCT/IB2016/058070

§ 371 (c)(1),
(2) Date: Jul. 17, 2018

(87) PCT Pub. No.: WO2017/125806

PCT Pub. Date: Jul. 27, 2017

(65) Prior Publication Data

US 2019/0024607 A1 Jan. 24, 2019

(30) Foreign Application Priority Data

Jan. 18, 2016 (IT) ..... 102016000003823

(51) Int. Cl.
*F02G 1/055* (2006.01)
*F28D 7/00* (2006.01)
(Continued)

(52) U.S. Cl.
CPC ..... *F02G 1/055* (2013.01); *F28D 7/005* (2013.01); *F28D 7/06* (2013.01); *F02G 2254/10* (2013.01);
(Continued)

(58) Field of Classification Search
CPC .. F02G 1/055; F02G 2254/10; F02G 2255/10; F28D 7/005; F28D 7/06; F28D 2021/0024
See application file for complete search history.

(56) References Cited

U.S. PATENT DOCUMENTS 5,385,467 A * 1/1995 Sebastiani ..... F23D 14/04 239/559
6,952,921 B2 * 10/2005 Qiu ..... F02G 1/055 60/517
(Continued)

FOREIGN PATENT DOCUMENTS

DE 10 2008 014 523 A1 9/2009
WO 2011/157662 A1 12/2011
WO 2015/033324 A2 3/2015

OTHER PUBLICATIONS

International Search Report and Written Opinion of the International Searching Authority for International Patent Application No. PCT/IB2016/058070 dated Apr. 10, 2017, 9 pages.

*Primary Examiner* — Mark A Laurenzi
*Assistant Examiner* — Shafiq Mian
(74) *Attorney, Agent, or Firm* — Merchant & Gould P.C.

(57) ABSTRACT

A burner-heat exchanger assembly (100) includes a burner (1) with a tubular diffuser wall (9), a combustion chamber (13) formed inside the diffuser wall (9), a heat exchanger (14) arranged in the combustion chamber (13) and having one or more heat exchange surfaces (31) exposed in the combustion chamber (13). A minimal diffuser-exchanger distance (C) between the diffuser wall (9) and the corresponding heat exchange surface (31) in the combustion chamber (13) ranges from 20 mm to 40 mm.

14 Claims, 5 Drawing Sheets

(51) Int. Cl.
*F28D 7/06* (2006.01)
*F28D 21/00* (2006.01)

(52) U.S. Cl.
CPC .. *F02G 2255/10* (2013.01); *F28D 2021/0024* (2013.01); *F28D 2021/0026* (2013.01)

(56) References Cited

U.S. PATENT DOCUMENTS

| | | | | |
|---|---|---|---|---|
| 8,015,808 | B2 * | 9/2011 | Keefer | F02B 43/10 60/517 |
| 8,387,380 | B2 * | 3/2013 | Roychoudhury | F02G 1/043 60/517 |
| 2016/0102858 | A1 * | 4/2016 | Acocella | F23D 14/58 431/354 |
| 2016/0215726 | A1 * | 7/2016 | Acocella | F02G 1/055 |
| 2018/0112870 | A1 * | 4/2018 | Gilioli | F23D 14/24 |

* cited by examiner

BURNER-HEAT EXCHANGER ASSEMBLY FOR AN EXTERNAL COMBUSTION ENGINE

This application is a National Stage Application of PCT/IB2016/058070, filed 29 Dec. 2016, which claims benefit of Ser. No. 10/201,6000003823, filed 18 Jan. 2016 in Italy and which applications are incorporated herein by reference. To the extent appropriate, a claim of priority is made to each of the above-disclosed applications.

BACKGROUND OF THE INVENTION

The present invention relates to a burner-heat exchanger assembly for an external combustion engine, in particular for a Stirling engine or for a Rankine cycle engine. As is known, Stirling engines implement the so-called Stirling cycle to convert thermal energy (in particular a thermal gradient) into work (in particular a cyclic kinematic movement) or vice versa by means of a closed cycle using a gas as thermodynamic fluid, usually air or nitrogen, or helium or hydrogen in the high performance versions. When a suitable difference in temperature is reached between a hot point and a cold point of the Stirling cycle, a cyclic pulsation is triggered, which is usually transformed into reciprocating motion of kinematic members, e.g. pistons or membranes. The pulsation lasts as long as the difference in temperature is maintained by administering heat to the hot point and subtracting heat from the cold point.

An alternative to Stirling engines are Rankine engines which implement the so-called Rankine cycle to convert thermal energy into work (in particular a cyclic kinematic movement) by means of an endoreversible thermodynamic cycle consisting of two adiabatic transformations and two isobar transformations.

The burners used as heat source for external combustion engines must provide the quantity of heat required by the thermodynamic cycle, have a size and shape such as to promote an efficient and quick heat exchange between the combustion gases and the thermodynamic fluid, adapt to the space conditions of the engine, avoid an undesired overheating of the components of the engine itself, resist high temperatures and possible "heat accumulations", resist mechanical stresses due to thermal expansions and the mechanical stresses, e.g. vibrations, due to the cyclical movement of the pistons of the external combustion engine.

The burner and heat exchanger assembly should promote the most efficient heat exchange possible in order to allow the external combustion engine to reach increased levels of energy efficiency.

Although they are satisfactory with reference to certain specific needs, burner-heat exchanger assemblies of the known art are not capable of reconciling the entirety of all the needs listed above in an optimal manner, in particular with reference to a quick and efficient heat exchange and to the thermal and/or mechanical stresses.

It is therefore the object of the present invention to provide a gas burner-heat exchanger assembly for an external combustion engine having features such as to best reconcile the needs listed above.

SUMMARY OF THE INVENTION

It is a particular object of the invention to provide a gas burner having features such as to improve the heat exchange rapidity and efficiency and to protect the components of the burner and external combustion engine from damage due to overheating and excessive thermal expansions.

According to one aspect of the invention, the burner-heat exchanger assembly comprises a burner and a heat exchanger, in which the burner comprises:

- a front wall defining a front side of the burner and forming a pass-through opening for the exchanger,
- a rear wall defining a rear side of the burner and forming a fume exhaust passage,
- a tubular side wall extending between the front wall and the rear wall and about a longitudinal axis,
- a tubular diffuser wall arranged inside the side wall and extending between the front wall and the rear wall and about the longitudinal axis, said diffuser wall having a perforation for the passage of a gas mixture from an outer side of the diffuser wall to an inner side of the diffuser wall where the combustion takes place,
- an annular distribution chamber formed between the side wall and the diffuser wall for the distribution of the gas mixture on the outer side of the diffuser wall,
- a combustion chamber formed inside the diffuser wall, said combustion chamber being defined on the rear side by the rear wall and suitable for introducing a heat exchanger from the front side through the pass-through opening for the exchanger of the front wall, in which the heat exchanger is formed by a tube assembly extending in the combustion chamber and intended to be passed through by a working fluid of the external combustion engine and having a heat exchange surface exposed in the combustion chamber, in which a minimal diffuser-exchanger distance, from the diffuser wall to the corresponding heat exchange surface, ranges from 20 mm to 40 mm.

Numerical simulations and experimentations have shown that in the aforesaid range of minimal diffuser-exchanger distance between the flame origin and the heat exchange surface, there is obtained a favorable reconciliation between the minimum temperature, the maximum temperature, the thermal gradient which causes the flow of hot combustion gases, the flow speed of the combustion gases inside the combustion chamber and the ability to transfer heat to the heat exchange surfaces, and therefore an increased energy efficiency of the burner-heat exchanger assembly.

According to one aspect of the invention, the diffuser wall is substantially cylindrical and coaxial to the longitudinal axis and the heat exchanger forms a group of radially external heat exchange surfaces arranged along a circumference about the longitudinal axis, in which the minimal diffuser-exchanger distance, measured in radial direction to the longitudinal axis, is of $C=D\times A\times K/(B\times D-2\times A\times K)+$tolerance, where:

A is the longitudinal height of the perforated area of the diffuser wall,

B is the longitudinal height of the heat exchange surfaces inside the combustion chamber, D is the external diameter of the heat exchanger, K=23,6747 is a constant value which has been experimentally determined.

The tolerance is ±7 mm, preferably ±3 mm, even more preferably ±1 mm.

BRIEF DESCRIPTION OF THE DRAWINGS

To better understand the invention and appreciate the advantages thereof, below are described non-limiting embodiments with reference to the figures, in which.

DETAILED DESCRIPTION OF THE PREFERRED EMBODIMENTS

Figure 1:
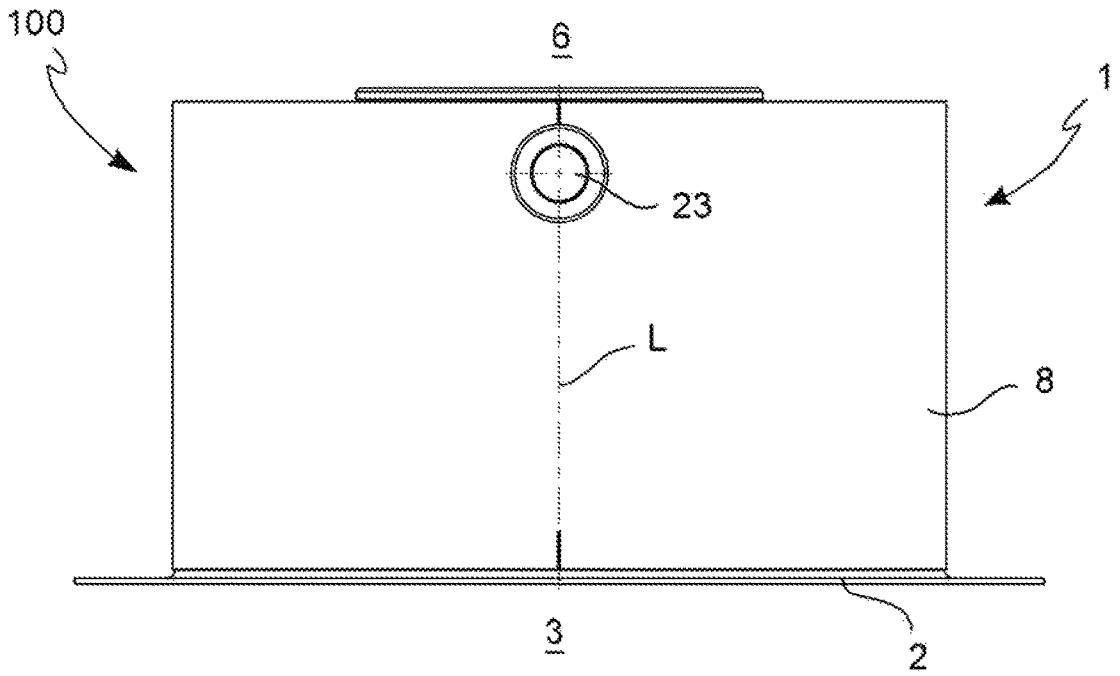
FIG. 1 is a side view of a burner-heat exchanger assembly for an external combustion engine according to an embodiment.
Figure 2:
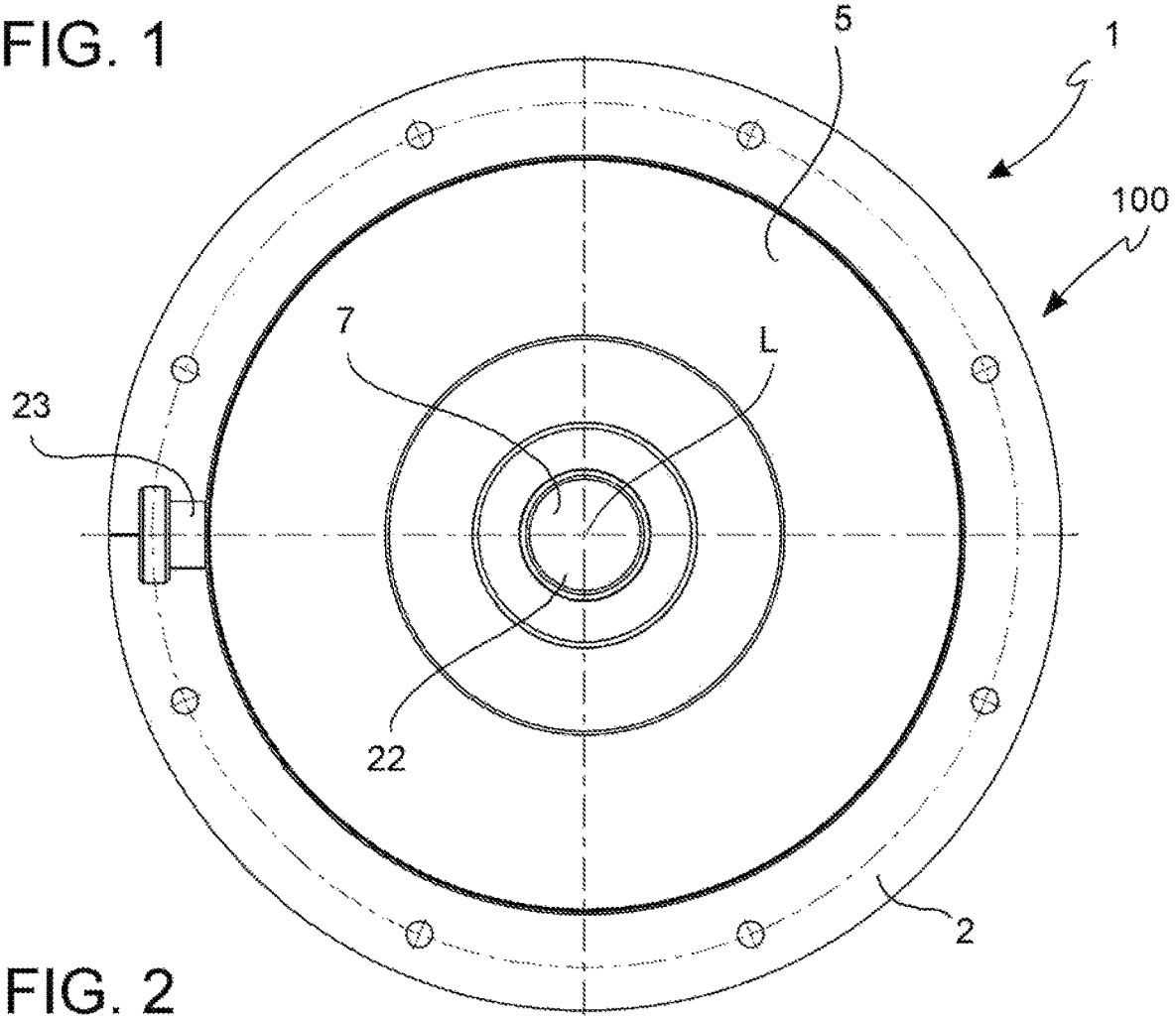
FIG. 2 is a top view of the burner-heat exchanger assembly in FIG. 1.
Figure 3:
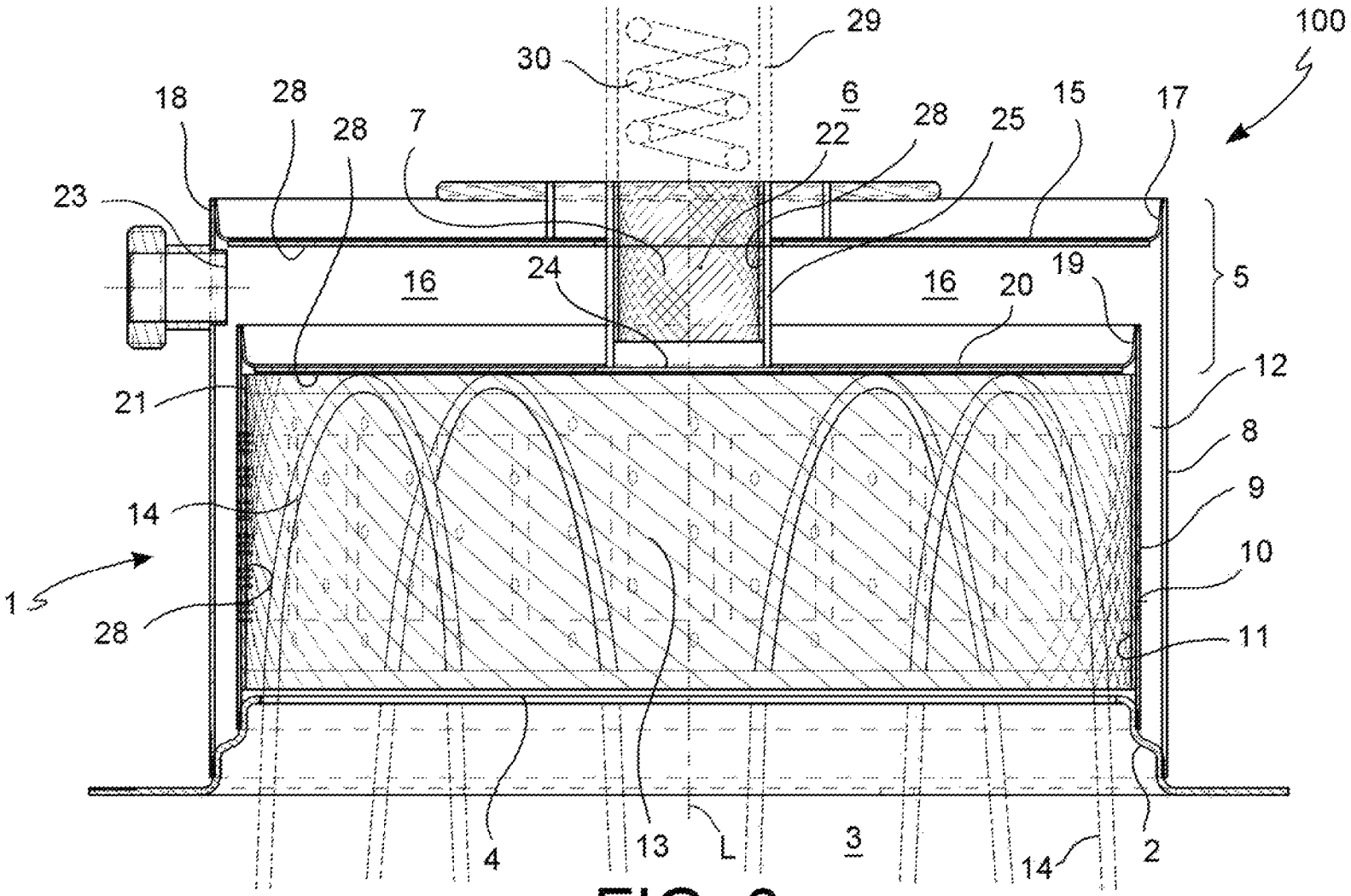
FIG. 3 is a longitudinal sectional view of the burner-heat exchanger assembly in FIG. 1.

With reference to the figures, a gas burner-heat exchanger assembly which can be used for external combustion engines, in particular for Stirling engines, is indicated as a whole with numeral 100. Assembly 100 comprises a gas burner 1 and a heat exchanger 14.

Burner 1 comprises a front wall 2 which defines a front side 3 of burner 1 and which forms a pass-through opening 4 for the exchanger, a rear wall 5 which defines a rear side 6 of burner 1 and which forms an opening 7 to exhaust combustion gases, and also a tubular side wall 8 extending between the front wall 2 and the rear wall 5 and about a longitudinal axis L.

Burner 1 further comprises a tubular diffuser wall 9 arranged inside the side wall 8 and extending between the front wall 2 and the rear wall 5 and about the longitudinal axis L. The diffuser wall 9 has a perforation for the passage of a gas mixture from an outer side 10 of the diffuser wall 9 to an inner side 11 of the diffuser wall 9 where the combustion takes place.

An annular distribution chamber 12 is formed between the side wall 8 and the diffuser wall 9 to distribute the gas mixture on the outer side 10 of the diffuser wall 9. A combustion chamber 13 is formed inside the diffuser wall 9, which chamber is delimited on the rear side by the rear wall 5 and is suitable for introducing a heat exchanger 14 from the front side 3 through the pass-through opening for the exchanger 4 of the front wall 2.

The heat exchanger 14 is formed by a tube assembly extending in the combustion chamber 13 and intended to be passed through by a working fluid, e.g. helium, of the external combustion engine and having a heat exchange surface 31 exposed in the combustion chamber 13, in which a minimal diffuser-exchanger distance C, from the diffuser wall 9 to the corresponding heat exchange surface 31, ranges from 20 mm to 40 mm.

Numerical simulations and experimentations have shown that, regardless of the sizing and the thermal input of the burner and regardless of the sizing of the heat exchanger and of the flow speed of the working fluid, in the aforesaid range of minimal diffuser-exchanger distance C between the flame origin (diffuser wall) and the heat exchange surface 31 closest to the flame origin, there is obtained a favorable reconciliation inside the combustion chamber 13 between the minimum temperature, the maximum temperature, the thermal gradient which causes the flow of hot combustion gases, the flow speed of the combustion gases and the ability to transfer heat to the heat exchange surfaces, and therefore an increased energy efficiency of the burner-heat exchanger assembly 100 with respect to the solutions of the prior art.

According to one embodiment, the diffuser wall 9 is substantially cylindrical and coaxial to the longitudinal axis L and the heat exchanger 14 forms a group of radially external heat exchange surfaces 31 arranged along a circumference about the longitudinal axis L (thus giving the heat exchanger 14 a cylindrical or cylindrical ring outer outline), in which the minimal diffuser-exchanger distance C, measured in a radial direction to the longitudinal axis L, is $C=D\times A\times K/(B\times D-2\times A\times K)+\text{tolerance}$, where:

A is the longitudinal height of the perforated area of the diffuser wall 9,

B is the longitudinal height of the heat exchange surfaces 31 inside the combustion chamber 13, D is the external diameter of the heat exchanger 14 inside the combustion chamber 13, K=23,6747 is a constant value which has been experimentally determined.

The tolerance is ±7 mm, preferably ±3 mm, even more preferably ±1 mm.

Figure 4:
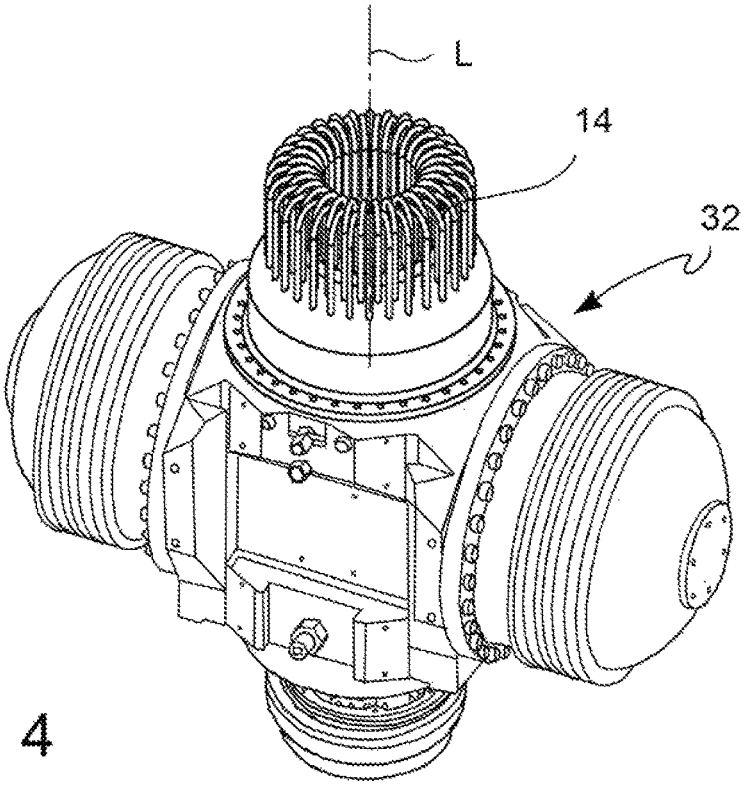
FIG. 4 shows a Stirling engine, in which a burner was removed to show the heat exchanger.

According to one embodiment, the longitudinal height A of the perforated area of the diffuser wall 9 is A=80 mm . . . 89.9 mm . . . 100 mm, the longitudinal height B of the heat exchange surfaces 31 inside the combustion chamber 13 is B=80 mm . . . 90 mm . . . 100 mm, and the external diameter D of the heat exchanger 14 inside the combustion chamber 13 is D=175 mm . . . 182.95 mm . . . 190 mm. This geometrical configuration is particularly efficient for the sizes and inputs of external combustion engines 32 typically used in the industry (FIG. 4). In this preferred embodiment (underlined values), the minimal diffuser-exchanger distance C which results in a maximum heat exchange efficiency (referred to the choice of distance C, but not necessarily total extremal with reference to all the geometrical, fluid-dynamic and thermodynamic parameters) is C=31.9 mm.

Without the technical correction coefficient K proposed by the present invention, the internal surface area of the cylindrical diffuser wall of the burner may be estimated by means of the equation $\text{Area_burner}=A\times(D+2\times C)\times\pi$ with ($\pi$=greek PI). However, without the technical correction coefficient K, the burner surface systematically is not optimal both with reference to the NOx, CO emissions and with reference to the heat exchange efficiency.

Precisely to overcome the problem of having to identify technically advantageous solutions by means of tedious experimental tests and numerical solutions for which no recipes or strategies exist which inevitably or convergingly result in an optimized result, the invention proposes to choose the minimum diffuser-heat exchanger distance C between 20 mm and 40 mm, and more particularly to determine the minimum diffuser-heat exchanger distance C by means of the formula indicated above and using the technical correction coefficient K=23,6747.

The heat exchanger 14 may comprise a continuous single heat exchange surface 31, for example, a compact monoblock, corrugated, fretted, finned surface, or a plurality of surfaces, for example outer surfaces of tubes and/or flat parallel surfaces, corrugated, fretted, finned surfaces or other known shapes not herein described in detail. The thermodynamic working fluid may be e.g. air, nitrogen, helium or hydrogen.

Figure 5:
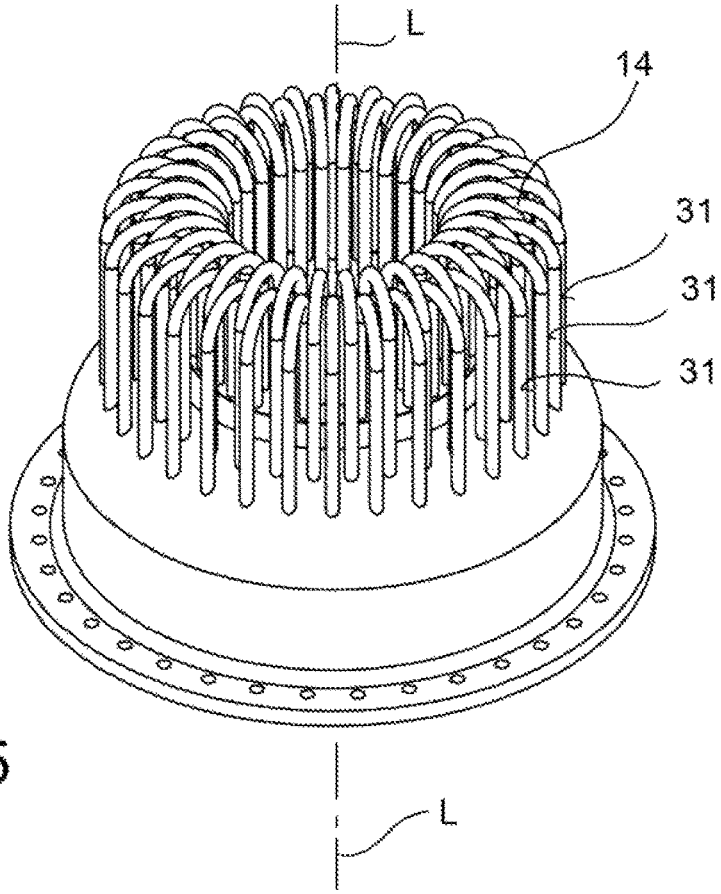
FIG. 5 shows a heat exchanger of a burner-heat exchanger assembly according to an embodiment.
Figure 6:
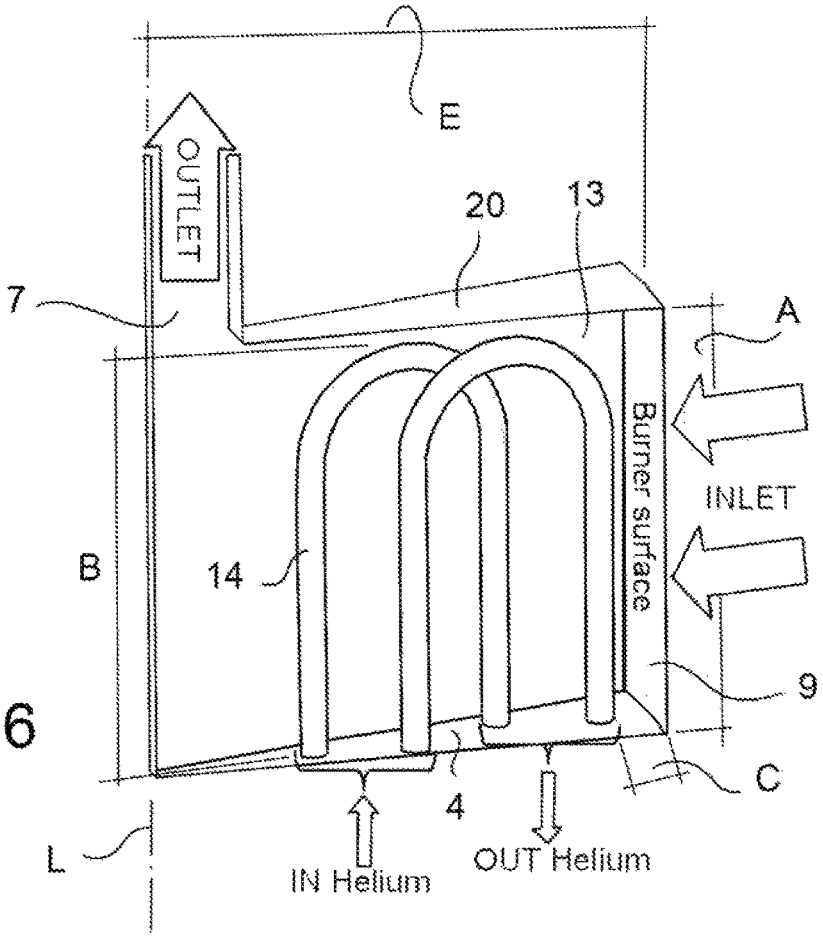
FIG. 6 is a diagrammatical depiction of a combustion chamber delimited by a diffuser wall and a heat exchanger, in an angular segment, indicating the fuel mixture flows of the burner, the working fluid of the external combustion engine and the outlet flow of the combustion gases.
Figure 7:
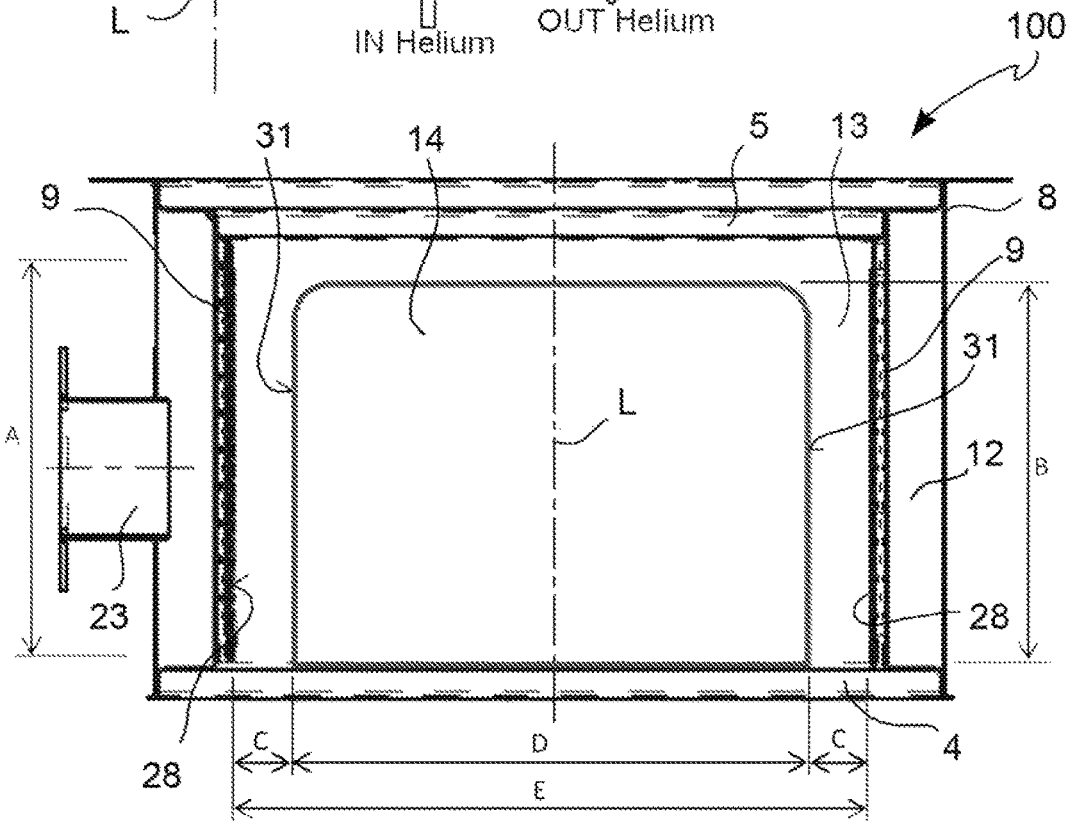
FIG. 7 is a sectional view according to a radial plane, of a burner-heat exchanger assembly according to the invention, indicating the pertinent geometrical parameters.

In an advantageous but non-limiting embodiment, the heat exchanger 14 comprises a sequence of straight tube lengths which are parallel to the longitudinal axis L, for example U-shaped tubes and all oriented on planes which are radial to the longitudinal axis L, in which the two legs of the "U" form straight lengths which are parallel to the longitudinal axis L. The U-shaped tubes may form a first tube assembly, radially more external, which alternates with tubes, radially more internal, of a second tube assembly, in which all the tubes of each assembly have the same radial distance from the longitudinal axis L, as shown in FIGS. 4 and 5.

According to one embodiment, in the rear wall 5 is formed a cooling gap 16 in flow communication with a gas inlet opening 23 and with the distribution chamber 12 so that the flow of the gas mixture can cool the diffuser wall 9 and also the rear wall 5.

In one embodiment shown in the figures, the rear wall 5 comprises an outer layer 15 (outer metal sheet) having an outer peripheral edge 17 connected with a rear edge 18 of the side wall 8, and an inner layer 20 (inner metal sheet) spaced apart from the outer layer 15 and arranged between the outer layer 15 and the combustion chamber 13 and having an outer peripheral edge 19 connected with a rear edge 21 of the diffuser wall 9. The cooling gap 16 is formed between the outer 15 and inner 20 layers and forms together with the annular distribution chamber 12 a cup-shaped distribution cavity.

Due to the configuration of the distribution 12 and combustion 13 chambers and to the presence of the cooling gap 16 in the rear wall 5, combustion may take place all about the heat exchanger 14. Moreover, undesired thermal dispersions and overheating of the bottom wall and diffuser wall are avoided due to the fact that the flow of gas mixture absorbs the heat in these areas and brings it back into the combustion chamber.

This ensures a quick and efficient heat exchange with reduced thermal dispersions, and protects the rear wall and nearby components from overheating.

An exhaust tube 25 is positioned, for example inserted and possibly welded, at central openings 22, 24 of the outer layer 15 and of the inner layer 20, which tube 25 forms a fume exhaust channel extending through the fume exhaust opening 7 of the rear wall 5. The cooling slot 16 extends with an annular shape about the exhaust tube 25.

The side wall 8 and the diffuser wall 9 are preferably cylindrical and possibly coaxial. The side wall 9 advantageously is made of steel and forms the mixture inlet opening 23 which can be connected to a conduit for supplying the fuel gas mixture (not shown in the figures).

As is known, and therefore not shown in the figures, the perforated areas of the diffuser wall 9 do not necessarily have a perfectly uniform hole shape and distribution. The individual holes may have different shapes and comprise e.g. circular holes, longitudinal longholes or slots, circumferential longholes or slots, and the distance thereof may vary. In particular, the individual holes may be grouped into perforation blocks spaced apart from one another by means of thin strips of wall.

Additionally or alternatively, the perforated steel sheet of the diffuser wall 9 is covered on the inside with a mesh or fabric layer 28 made of metal, e.g. FeCr alloy, or ceramic or sintered material, which forms the inner surface 11 of the diffuser wall 9 on which the combustion takes place, and moreover performs an insulating function which further increases the thermal resistance of burner 1. Here, the minimum diffuser-heat exchanger distance C refers to the inner surface of the mesh or fabric layer 28 because, as explained above, C represents the minimum distance between the heat exchange surface and the flame area of origin.

According to one embodiment, the side wall 8 and the diffuser wall 9 may be connected to the front 2 and rear 5 walls by means of pressfit and/or welding.

The front wall 2 is preferably made of steel and may have the shape of an annular disc, preferably circular, with an outer edge which may be used for connecting the burner 1 to the Stirling engine, an intermediate portion to which the side wall 8 and the diffuser wall 9 may be connected and an inner edge which defines the aforesaid opening 4 for the passage of the heat exchanger 14.

According to a further embodiment, a surface of the inner layer 20 facing the combustion chamber 13 and possibly also an inner surface of the fume exhaust passage 7 (i.e. of the exhaust tube 25) may be covered by means of a heat-resistant mesh or fabric which is identical or similar to mesh or fabric 28, in order to provide a further mechanical protection and heat barrier.

Indeed, the first heat exchanger 14 is connected preferably immediately close to or in direct contact with the inner layer 20 in order to avoid any "escape" of exploitable heat toward the fume exhaust 7. However, this may result in a risk of mechanical damage due to the vibrations of the heat exchanger 14, which is subjected to pulsations of the thermodynamic fluid and to the mechanical vibrations of the Stirling engine.

According to a further embodiment, also the metal sheet of the outer layer 15 is covered by means of a heat-resistant mesh or fabric which is identical or similar to mesh or fabric 28, in order to provide a further thermal protection.

In one embodiment, a second heat exchanger 30 may be provided, arranged on the rear side 6 of burner 1 and having one or more fluid conduits in heat exchange relation with a fume exhaust conduit 29 connected to the fume exhaust opening 7 of the rear wall 5.

Figure 8:
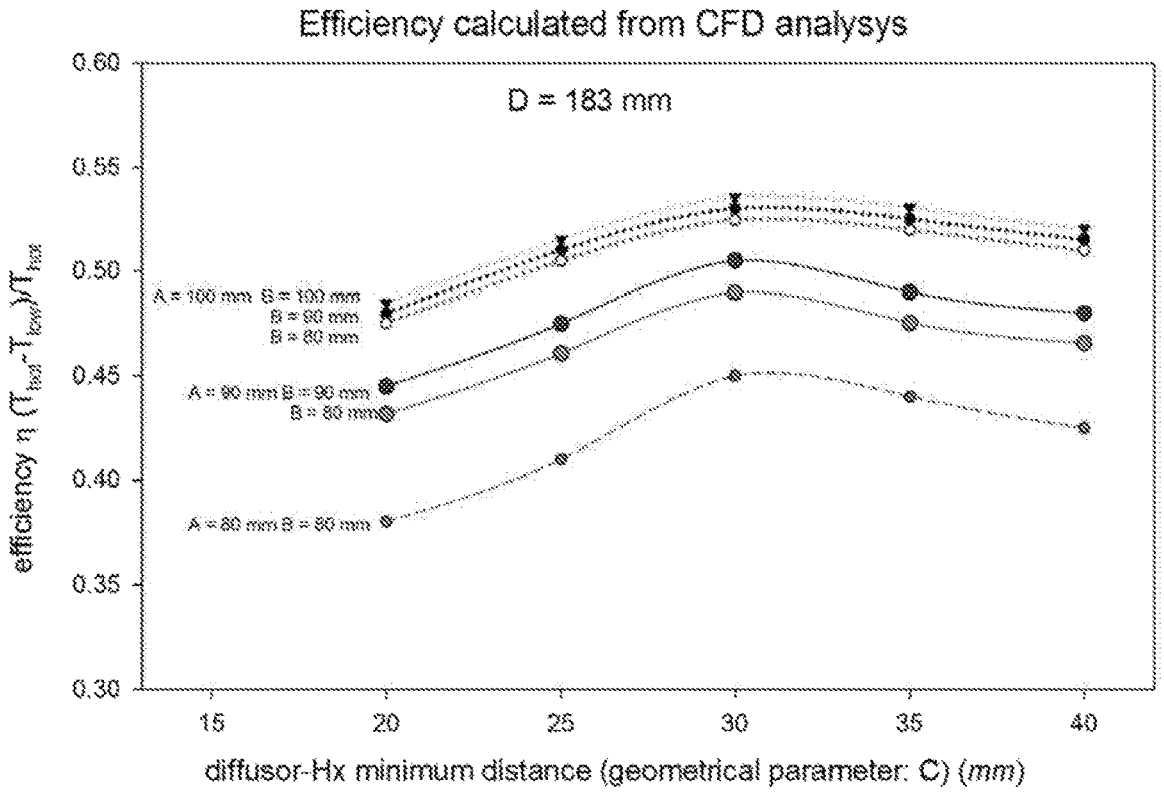
FIGS. 8 and 9 show graphs of CFD simulations and experimental data concerning the technical effect of the invention.
Figure 9:
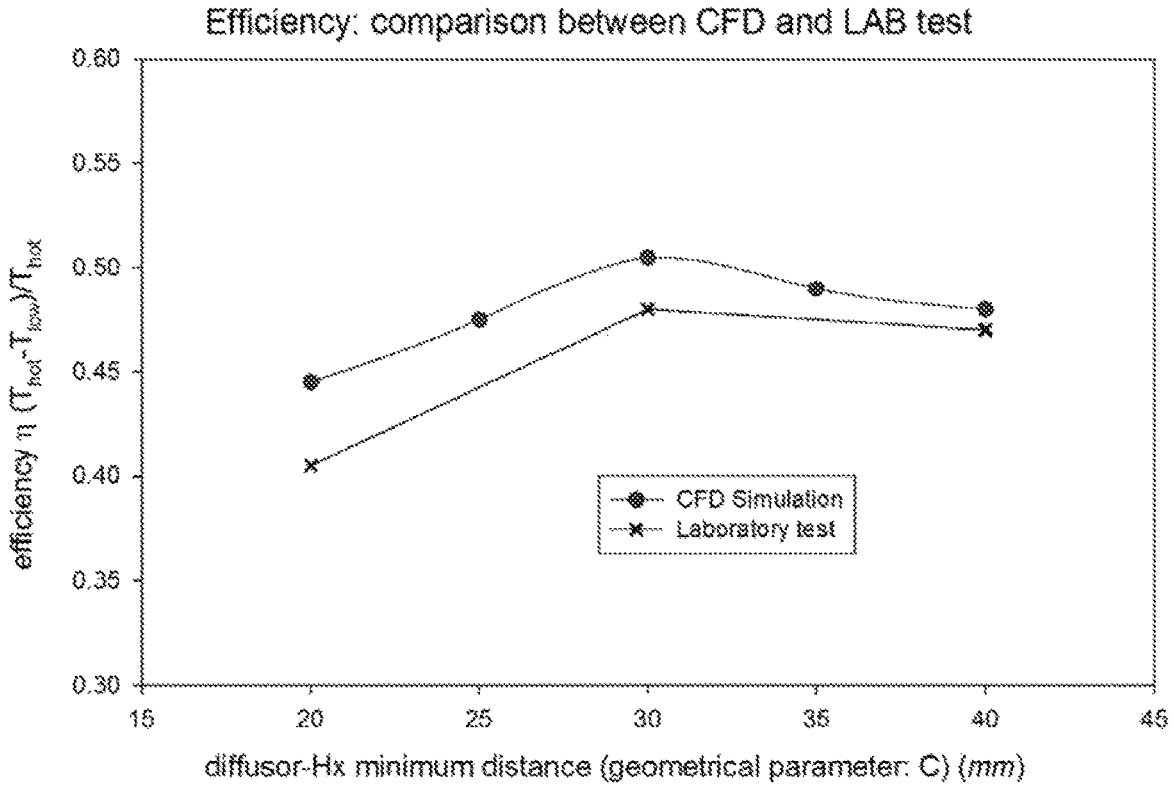

FIGS. 8 and 9 show graphs of CFD simulations and experimental data concerning the technical effect of the invention. The ordinate indicates the energy efficiency of the system, calculated according to the formula shown in the figure.

The T_hot and T_low and temperature values are values calculated numerically in the simulated domain (in the case of numerical simulation CFD) and measured by thermocouples applied to the heat exchangers in the case of laboratory tests.

The A parameter takes the values 100, 90 and 80 mm (in CFD simulations).

The B parameter takes the values 100, 90 and 80 mm (with the condition to not exceed A).

The C parameter takes the values 20 mm, 25 mm, 30 mm, 35 mm in the CFD simulation, and 20 mm, 30 mm and 40 mm in laboratory tests. This variation of the parameter C is achieved by varying the diameter of the burner and leaving the diameter of the heat exchanger constant at D=183 mm (in the configuration that has been numerically simulated and tested in the laboratory).

The graphs indicate the maximum efficiency around C=30 mm.

Obviously, one person skilled in the art, with the object of meeting contingent and specific needs, can make further changes and variants to the burner-heat exchanger assembly 100 according to the present invention, moreover all contained within the scope of protection of the invention, which is defined by the following claims.

The invention claimed is:

1. Gas burner-heat exchanger assembly for an external combustion engine, comprising a gas burner and a heat exchanger, the gas burner comprising:

a front wall defining a front side of the gas burner and forming a pass-through opening for the exchanger, a rear wall defining a rear side of the gas burner and forming an opening to exhaust combustion gases, a tubular side wall extended between the front wall and the rear wall and about a longitudinal axis of the assembly, a tubular diffuser wall arranged inside the side wall and extended between the front wall and the rear wall and about the longitudinal axis, the diffuser wall having a perforation for the passage of a gas mixture from an outer side of the diffuser wall to an inner side of the diffuser wall where combustion takes place, an annular distribution chamber formed between the side wall and the diffuser wall to distribute the gas mixture on the outer side of the diffuser wall, a combustion chamber formed inside the diffuser wall and delimited on a rear side by the rear wall, the combustion chamber receiving the heat exchanger, wherein the heat exchanger is formed by a tube assembly extended in the combustion chamber and passed through by a working fluid of the external combustion engine and having a heat exchange surface exposed in the combustion chamber, wherein a minimal diffuser-exchanger distance between the diffuser wall and the corresponding heat exchange surface ranges from 20 mm to 40 mm.

2. The gas burner-heat exchanger assembly according to claim 1, wherein the diffuser wall is substantially cylindrical and coaxial to the longitudinal axis and the heat exchanger forms a group of radially external heat exchange surfaces arranged along a circumference about the longitudinal axis, wherein the minimal diffuser-exchanger distance, measured in a radial direction with respect to the longitudinal axis, is:

$$C=D\times A\times K/(B\times D-2\times A\times K)+\text{tolerance},$$

where:

A is the longitudinal height of the perforated area of the diffuser wall,

B is the longitudinal height of the heat exchange surfaces inside the combustion chamber, D is the external diameter of the heat exchanger inside the combustion chamber, K=23,6747, wherein the tolerance is ±7 mm.

3. The gas burner heat exchanger assembly according to claim 1, wherein a longitudinal height of the perforated area of the diffuser wall ranges from 80 mm to 100 mm, a longitudinal height of the heat exchange surfaces inside the combustion chamber ranges from 80 mm to 100 mm, and an external diameter of the heat exchanger inside the combustion chamber ranges from 175 mm to 190 mm.

4. The gas burner heat-exchanger assembly according to claim 3, wherein the longitudinal height of the perforated area of the diffuser wall is A=90 mm, the longitudinal height of the heat exchange surfaces inside the combustion chamber is B=90 mm, and the external diameter of the heat exchanger inside the combustion chamber is D=183 mm.

5. The gas burner-heat exchanger assembly according to claim 4, wherein the minimal diffuser-exchanger distance ranges from 29 mm to 35 mm, preferably 32 mm.

6. The gas burner-heat exchanger assembly according to claim 1, wherein the heat exchanger comprises a plurality of straight tube lengths parallel with respect to the longitudinal axis.

7. The gas burner-heat exchanger assembly according to claim 1, wherein the heat exchanger comprises U-shaped tubes, wherein the two legs of the "U" form straight lengths parallel with the longitudinal axis.

8. The gas burner-heat exchanger assembly according to claim 7, wherein the U-shaped tubes are all oriented in planes radial with respect to the longitudinal axis and form a first tube assembly, radially more external, which alternates with tubes, radially more internal, of a second tube assembly, wherein all the tubes of each assembly have a same radial distance from the longitudinal axis.

9. The gas burner-heat exchanger assembly according to claim 1, wherein the diffuser wall is internally coated with a mesh or fabric layer forming an internal combustion surface of the diffuser wall.

10. External combustion engine comprising a gas burner-heat exchanger assembly according to claim 1.

11. The gas burner-heat exchanger assembly according to claim 1, wherein the external combustion engine comprises a Stirling engine.

12. The gas burner-heat exchanger assembly according to claim 2, wherein the tolerance is ±3 mm.

13. The gas burner-heat exchanger assembly according to claim 2, wherein the tolerance is ±1 mm.

14. The gas burner-heat exchanger assembly according to claim 4, wherein the minimal diffuser-exchanger distance is 32 mm.

* * * * *